US005577272A

United States Patent [19]

Fisher

[11] Patent Number: 5,577,272

[45] Date of Patent: Nov. 26, 1996

[54] FINGER SLEEVES

[76] Inventor: Odis C. Fisher, 373 Henry Ave., Stratford, Conn. 06497

[21] Appl. No.: 453,520

[22] Filed: May 30, 1995

[51] Int. Cl.[6] ..... A41D 19/00

[52] U.S. Cl. ..... 2/21; 273/1.5 A; 2/163

[58] Field of Search ..... 2/21, 163; D3/29; 602/22, 63, 30; 128/880; 623/11, 12, 21, 57, 64, 66; 223/101; 273/1.5 R, 1.5 A

[56] References Cited

U.S. PATENT DOCUMENTS

| | | | |
|---|---|---|---|
| 80,755 | 8/1868 | McBeth | 223/101 |
| 490,733 | 1/1893 | Armat | 223/101 X |
| 518,027 | 4/1894 | English | 2/21 |
| 911,838 | 2/1909 | Napier | 2/21 X |
| 2,528,976 | 11/1950 | Schiavone | 223/101 |
| 2,536,979 | 1/1951 | Furedi | 223/101 |
| 4,149,661 | 4/1979 | Curtiss | 223/101 |
| 4,881,275 | 11/1989 | Cazares et al. | 2/163 X |

*Primary Examiner*—Paul C. Lewis

[57] ABSTRACT

A finger sleeve comprising a finger sleeve of a varying length as a function to correspond to the length of a user's finger and positionable upon the user's finger, the finger sleeve having an external surface with a proximal end having a finger-receiving opening, a distal end having a closed spherical extent and a long intermediate extent therebetween with a conical extent, and a short cylindrical extent at the end of the conical extent; the finger sleeve having a hollow internal surface with a proximal end having a finger-receiving opening, a distal end with a closed spherical extent and a long intermediate extent therebetween with a conical surface, and a short cylindrical extent adjacent to the internal end; the finger sleeve having a solid region between the conical surfaces and between the exterior surface at the distal end; and the finger sleeve as set forth in claim 1 wherein the finger sleeve is fabricated of an elastomeric material selected from the class of elastomeric materials including plastic and rubber, natural and synthetic and blends thereof.

1 Claim, 3 Drawing Sheets

FINGER SLEEVES

BACKGROUND OF THE INVENTION

1. Field of the Invention

The present invention relates to new and improved finger sleeves and, more particularly, pertains to extending the effective length of a basketball player's fingers to facilitate one-handed dunks.

2. Description of the Prior Art

The use of devices for receiving a user's fingers for a wide variety of purposes is known in the prior art. More specifically, devices for receiving a user's fingers for a wide variety of purposes heretofore devised and utilized for the purpose of facilitating the grasping of objects through a wide variety of methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for extending the effective length of a basketball player's fingers to facilitate one-handed dunks. By way of example, U.S. Pat. No. 4,881,275 to Cazares et al. discloses a basketball gripping glove constructed of a wrist anchor strap with a plurality of five elastomeric bands extending therefrom the other end of the bands being each attached to a single finger cowl for the five fingers of one's hand.

U.S. Pat. No. 5,082,265 to Bergman discloses a grip augmenting bowling ball handling apparatus enabling persons having limited gripping ability and others interested in an alternate way of bowling to hold and release a bowling ball.

Lastly, U.S. Pat. No. 5,127,648 to Mallick discloses a football with finger-grip pocket with a flange and finger grip bar glued and sewn into a section of a football such that a player can insert his fingers into the pocket opening against the bar thus enabling him to hold onto the ball with more firmness, or throw and spin the ball with added accuracy.

In this respect, the finger sleeves according to the present invention substantially departs from the conventional concepts and designs of the prior art, and in doing so provides an apparatus primarily developed for the purpose of extending the effective length of a basketball player's fingers to facilitate one-handed dunks.

Therefore, it can be appreciated that there exists a continuing need for new and improved finger sleeves which can be used for extending the effective length of a basketball player's fingers to facilitate one-handed dunks. In this regard, the present invention substantially fulfills this need.

SUMMARY OF THE INVENTION

In view of the foregoing disadvantages inherent in the known types of devices for receiving a user's fingers for a wide variety of purposes now present in the prior art, the present invention provides improved finger sleeves. As such, the general purpose of the present invention, which will be described subsequently in greater detail, is to provide new and improved finger sleeves and methods which have all the advantages of the prior art and none of the disadvantages.

To attain this, the present invention essentially comprises new and improved finger sleeves for extending the effective length of a basketball player's fingers to facilitate one-handed dunks comprising, in combination, five finger sleeves of varying lengths as a function to correspond to the length of a user's fingers and positionable upon the user's fingers; each of the finger sleeves having external surfaces with a proximal end having a finger-receiving opening, a distal end having a closed spherical extent and a long intermediate extent therebetween with a conical extent and a short cylindrical extent at the conical extent constituting between about five and ten percent of the length of each finger sleeve; each of the finger sleeves having a hollow internal surface with a proximal end having a finger-receiving opening, a distal end with a closed spherical extent and a long intermediate extent therebetween with a conical surface, and a short cylindrical extent at the proximal end constituting between about five and ten percent of the length of each finger sleeve; each of the fingers having a sold region between the conical surfaces and between the exterior and interior spherical surfaces, the solid region constituting between about thirty and forty percent of the length of the finger sleeve in which it is located; and each of the finger sleeves being fabricated of an elastomeric material selected from the class of elastomeric materials including plastic and rubber, natural and synthetic and blends thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved finger sleeves which have all the advantages of the prior art devices for receiving a user's fingers for a wide variety of purposes and none of the disadvantages.

It is another object of the present invention to provide new and improved finger sleeves which may be easily and efficiently manufactured and marketed.

It is a further object of the present invention to provide new and improved finger sleeves which are of a durable and reliable construction.

An even further object of the present invention is to provide new and improved finger sleeves which are susceptible of a low cost of manufacture with regard to both materials and labor, and which accordingly are then susceptible of low prices of sale to the consuming public, thereby making such devices for receiving a user's fingers for a wide variety of purposes economically available to the buying public.

Still yet another object of the present invention is to provide new and improved finger sleeves which provide in the apparatuses and methods of the prior art some of the advantages thereof, while simultaneously overcoming some of the disadvantages normally associated therewith.

Even still another object of the present invention is to extend the effective length of a basketball player's fingers to facilitate one-handed dunks.

Lastly, it is an object of the present invention to provide a finger sleeve comprising a finger sleeve of a varying length as a function to correspond to the length of a user's finger and positionable upon the user's finger, the finger sleeve having an external surface with a proximal end having a finger-receiving opening, a distal end having a closed spherical extent and a long intermediate extent therebetween with a conical extent, and a short cylindrical extent at the end of the conical extent; the finger sleeve having a hollow internal surface with a proximal end having a finger-receiving opening, a distal end with a closed spherical extent and a long intermediate extent therebetween with a conical surface, and a short cylindrical extent adjacent to the internal end; the finger sleeve having a solid region between the conical surfaces and between the exterior surface at the distal end; and the finger sleeve as set forth in claim 1 wherein the finger sleeve is fabricated of an elastomeric material selected from the class of elastomeric materials including plastic and rubber, natural and synthetic and blends thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
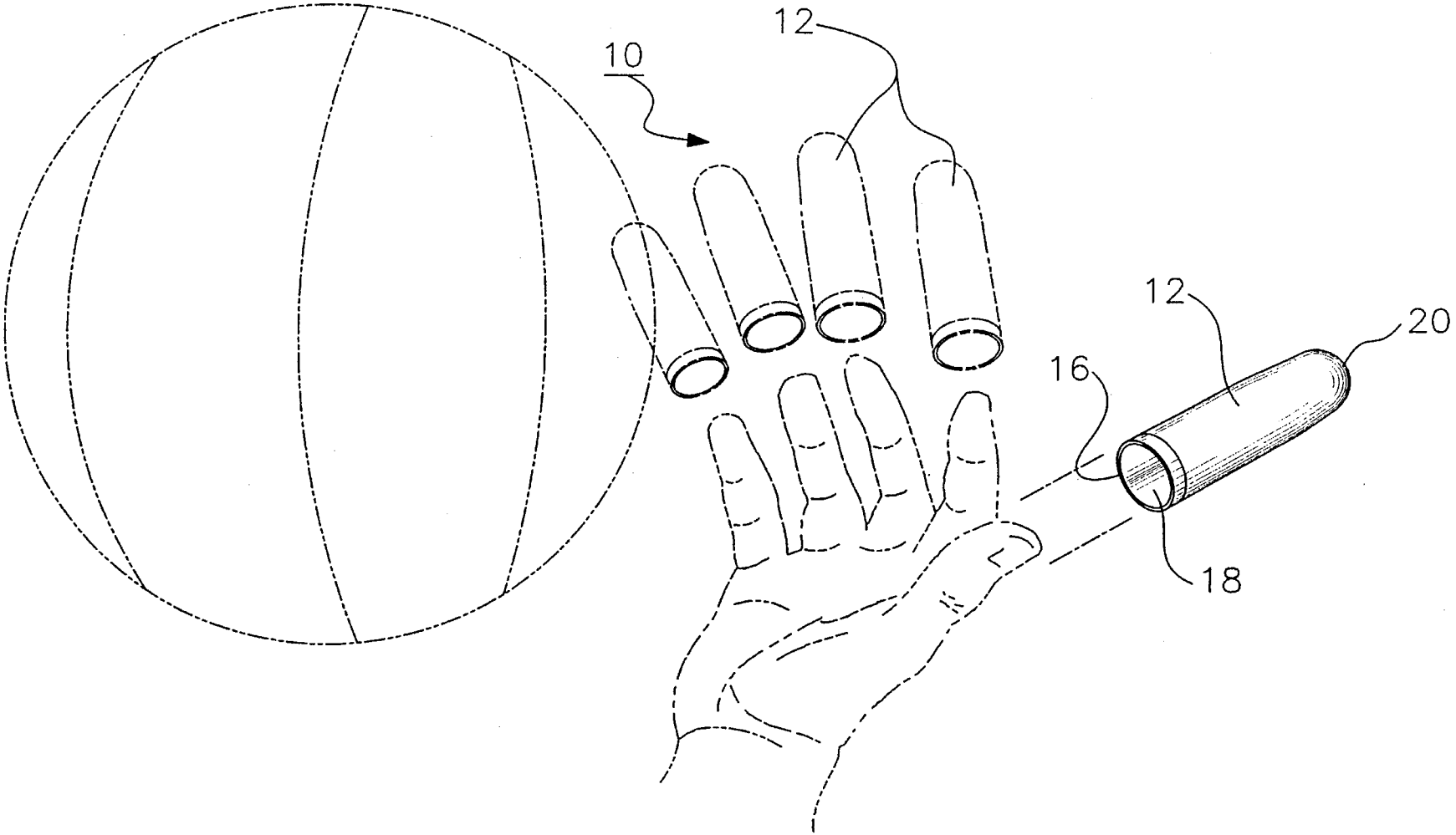
FIG. 1 is a perspective view of the primary embodiment of the new and improved finger sleeves for extending the effective length of a basketball player's fingers to facilitate one-handed dunks constructed in accordance with the present invention.
Figure 2:
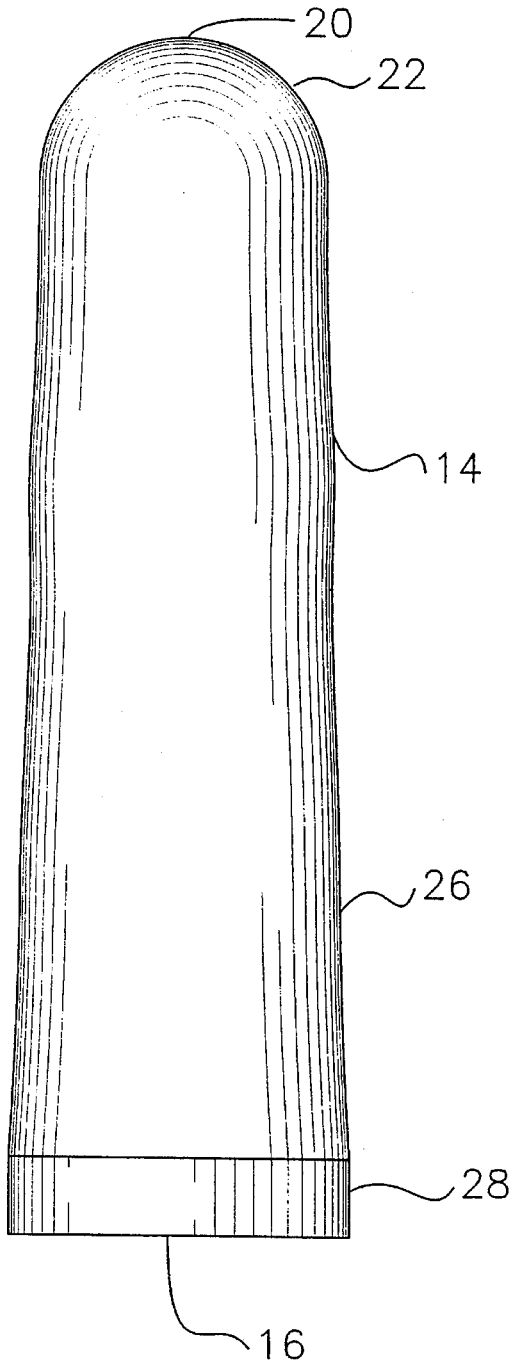
FIG. 2 is an enlarged front view of one of the finger sleeves shown in FIG. 1.
Figure 3:
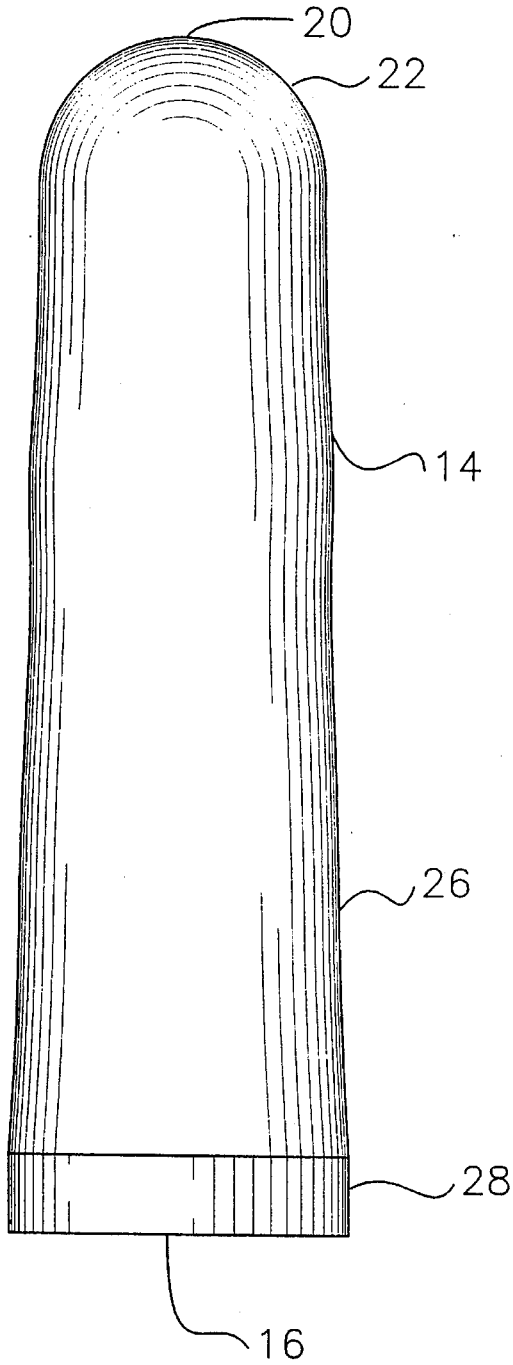
FIG. 3 is a side elevational view of one of the finger sleeves shown in FIG. 1.
Figure 4:
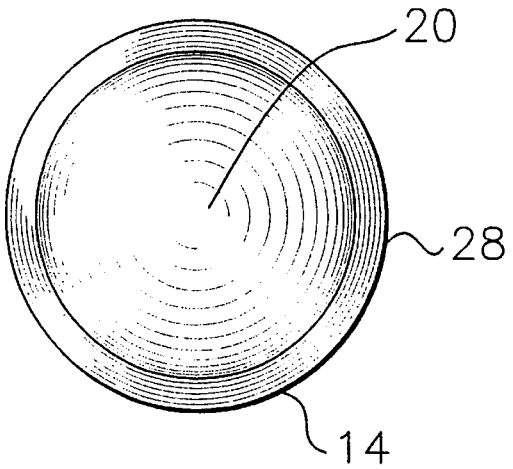
FIG. 4 is a top plan view of a finger sleeve shown in the prior Figures.
Figure 5:
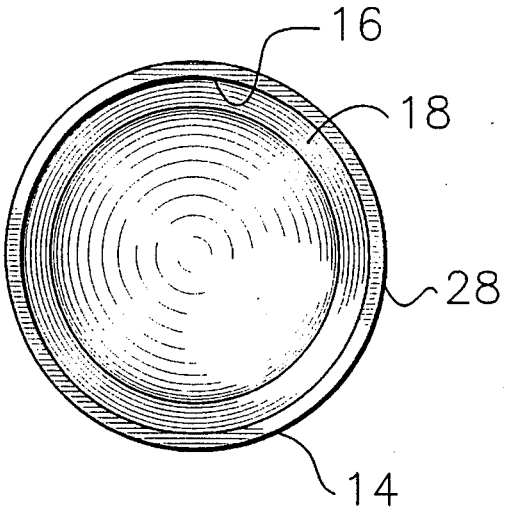
FIG. 5 is a bottom view of a finger sleeve shown in the prior embodiment.
Figure 6:
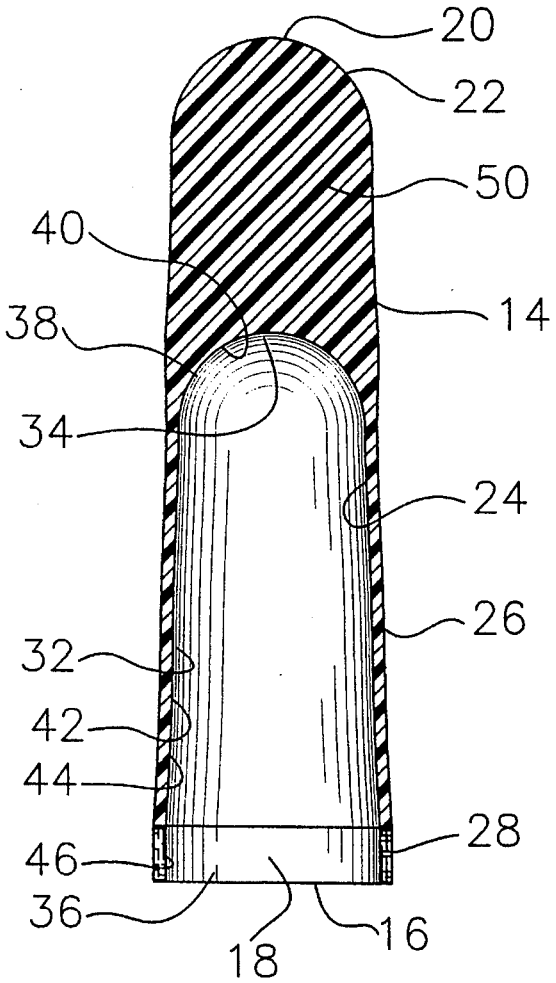
FIG. 6 is a cross-sectional view taken axially through the center of one of the finger sleeves shown in the prior embodiment.

With reference now to the drawings, and in particular to FIG. 1 thereof, the preferred embodiment of the new and improved finger sleeves embodying the principles and concepts of the present invention and generally designated by the reference numeral 10 will be described.

The present invention, the new and improved finger sleeves to extend the effective length of a basketball player's fingers to facilitate one-handed dunks, is a system 10 comprised of a plurality of components. In their broadest context, the components include a finger sleeve, or more particularly, a plurality of similar finger sleeves each having an external surface, an internal surface and a solid region.

More specifically, as shown in FIG. 1, each of the finger sleeves 12 is adapted to be used in association with four related finger sleeves. The five finger sleeves are thus adapted to be used on each of the five fingers of a user. Such sleeves preferably vary in length as a function corresponding to the length of the user's finger upon which it is to be positioned during operation and use. Such finger sleeves are each adapted to be of a size approximately equivalent to the length of the finger upon which it is located. Consequently, the five finger sleeves of a set are of varying lengths corresponding to the lengths of the fingers of the hands of the user. Since such finger sleeves are adapted to be used with children as well as adults, they may vary in total length anywhere from one inch to six inches.

Each of the finger sleeves is formed with an external surface 14. Each external surface has an proximal end 16. Each proximal end is formed with a finger-receiving opening 18. Each external surface also has a distal end 20 with a closed spherical extent 22. Located between the proximal end and distal end is a long intermediate extent 24. The intermediate extent is formed with an essentially conical extent 26. In addition, the external surface has a short cylindrical extent 28 at the end of the conical extent 26. The short cylindrical extent 28 extends between about five and ten percent of the length of the entire finger sleeve.

Each of the fingers also has a hollow internal surface 32. Each internal surface is formed with a proximal end 34 with a finger-receiving opening 36 coincident with the finger receiving opening of the external surface. Each internal surface also has a distal end 38 with a closed spherical extent 40. A long intermediate extent 42 with a conical surface 44 couples the distal and proximal ends of the internal surface. In addition, a short cylindrical extent 46 is located adjacent to the internal end and constitutes between about five and ten percent of the length of the finger sleeve.

Each of the finger sleeves also has a solid region 50. Such solid region is located between the conical surfaces and between the exterior surface at the distal end. The solid region constitutes between about thirty and forty percent of the length of the finger sleeve in which it is located.

In the preferred embodiment of the invention, the finger sleeves are fabricated of an elastomeric material. Preferably such elastomeric material is selected from the class of elastomeric materials including plastic and rubber, natural and synthetic, and blends thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. Finger sleeves for extending length of a basketball player's fingers to facilitate one-handed dunks comprising, in combination:

five separate finger sleeves of varying lengths as a function to correspond to the length of a user's fingers and positionable upon the user's fingers;

each of the finger sleeves having external surfaces with a proximal end having a finger-receiving opening, a distal end having a closed spherical extent and a long intermediate extent therebetween with a conical extent and a short cylindrical extent constituting between about five and ten percent of the length of each finger sleeve;

each of the finger sleeves having a hollow internal surface with a proximal end having a finger-receiving opening, a distal end with a closed spherical extent and a long intermediate extent therebetween with a conical surface, and a short cylindrical extent at the proximal end constituting between about five and ten percent of the length of each finger sleeve;

each of the finger sleeves having a solid region between the conical surfaces and between the exterior and interior spherical surfaces, the solid region between the exterior and interior spherical surfaces constituting between about thirty and forty percent of the length of the finger sleeve in which it is located, the solid region between the conical surfaces extends substantially the length of each finger and each of the finger sleeves being fabricated of an elastomeric material selected from the classes of elastomeric materials consisting of plastic and rubber, natural and synthetic and blends thereof.

* * * * *